US005328591A

United States Patent [19]

Raterman

[11] Patent Number: 5,328,591

[45] Date of Patent: Jul. 12, 1994

[54] MECHANICAL SHATTERING OF ASPHALTENES IN FCC RISER

[75] Inventor: Michael F. Raterman, Doylestown, Pa.

[73] Assignee: Mobil Oil Corporation, Fairfax, Va.

[21] Appl. No.: 960,347

[22] Filed: Oct. 13, 1992

[51] Int. Cl.[5] ..... C10G 47/00; C10G 11/00

[52] U.S. Cl. ..... 208/113; 208/108; 208/111; 208/118; 208/120

[58] Field of Search ..... 208/113, 118, 111, 120, 208/108

[56] References Cited

U.S. PATENT DOCUMENTS

| | | | |
|---|---|---|---|
| 4,601,814 | 7/1986 | Mauleon et al. | 208/113 |
| 4,814,067 | 3/1989 | Gartside et al. | 208/127 |
| 4,985,136 | 1/1991 | Bartholic | 208/153 |
| 5,096,566 | 3/1992 | Dawson et al. | 208/106 |

OTHER PUBLICATIONS

Oil & Gas Journal, Fluid Catalytic Cracking Report, Jan. 8, 1990, Avidan et al.

*Primary Examiner*—Howard T. Mars
*Assistant Examiner*—Michael B. Hydorn
*Attorney, Agent, or Firm*—Alexander J. McKillop; Malcolm D. Keen; Richard D. Stone

[57] ABSTRACT

An FCC process and apparatus for atomizing heavy feed are disclosed. A liquid feed containing stacked asphaltenes is pressurized, and preferably heated, with a gas such as light hydrocarbons. Pressurized gas and liquid discharge at high velocity into an expansion chamber, where shear force and sudden expansion disrupt stacked structures. Preferably, some thermal conversion, visbreaking, occurs in the expansion chamber. The disrupted feed is discharged into an FCC reactor, preferably to the base of a riser reactor, with a lighter feed, such as a gas oil, added higher up in the riser. Improved atomization and vaporization of the heavy feed in the riser increases conversion and reduces coke make.

18 Claims, 4 Drawing Sheets

MECHANICAL SHATTERING OF ASPHALTENES IN FCC RISER

BACKGROUND OF THE INVENTION

Field of the Invention

The invention relates to a process and apparatus for converting nondistillable hydrocarbons, such as asphaltenes or tar sands into lighter products in nozzle upstream of or within an FCC riser reactor.

Processes for the cracking of hydrocarbon feedstocks via contact at appropriate temperatures and pressures with fluidized catalytic particles are known in the art generically as "fluid catalytic cracking" (FCC).

Relatively low boiling point hydrocarbons, such as gas oils, are preferred feedstocks for FCC operations. Such hydrocarbons generally contain fewer contaminants and have a lower tendency to produce coke during the cracking operation than heavier hydrocarbons. However, the relatively low content of such light hydrocarbons in many current crude mixes has driven refiners to use heavier feeds, e.g., residual oils, as feedstocks to the FCC operation. Heavier feeds generally contain more metals which contaminate the catalyst and large complex hydrocarbons structures such as asphaltenes and porphyrins. These large, non-distillable hydrocarbons, sometimes referred to as Conradson Carbon Residue (CCR), or asphaltenics, usually are converted into coke, rather than cracked to lighter products. This increases the yield of coke during the cracking operation.

The high viscosity of these heavy fractions also makes them difficult to vaporize. Conventional approaches at feed atomization create large droplets of resid, which may not vaporize until half way up the riser, or even later, so the heavy ends are converted thermally. Some heavy liquid may be swept with spent catalyst into the regenerator and burned, though it was potentially convertible.

The difficulty of converting resids into lighter products depresses the value of this portion of the crude and provides great incentive for cracking it in FCC. Its use as FCC feed causes problems: metals contamination, feed atomization and feed vaporization. While use of metals scavengers, or catalysts which can tolerate large metals levels, or more frequent catalyst replacement, provides refiners with a way to deal with the metals problems, the resids are still hard to atomize and vaporize.

The state of the art on dealing with resid feeds will be reviewed, and then FCC feed atomization will be reviewed.

RESID ISOLATION

Historically, refiners have kept resid feeds from their FCC units. In the early days of FCC, gas oils were fed to the cat cracker, while resids were charged to purely thermal processes such as visbreaking or coking. The thermal products were not especially desirable. (Coker naphtha has such a high tendency to form gum that it borders on a disposal problem rather than a valuable product, but at least they were more valuable than the resid fed to the thermal process.)

To avoid sending such a large part of the whole crude (the resid) to thermal process, refiners used vacuum distillation column to recover a heavy, but distilled feed, vacuum gas oil (VGO) from the resid. The VGO went to the FCC, and only the vacuum resid was sent to a coker etc.

In addition to coking and visbreaking, processes of last resort for difficult feeds, some other exotic thermal processes have been developed for resids and/or tar sands.

Fluid cokers convert tar sands to lighter products. A similar approach was developed for resids, using a riser contactor to vaporize and demetalize resid feeds. An inert or low activity contact material provided surface area for feed metal deposition and produced a low quality vapor product which was charged to a conventional catalytic cracking unit. Much of the feed was converted to coke, which deposited on the contact material to be burned off in a fluidized contact material regenerator.

The Thermal Regenerative Cracker (TRC) disclosed in U.S. Pat. No. 4,370,303 is a fluid bed process which is an olefin cracker.

A tar sands conversion process is disclosed in U.S. Pat. No. 5,096,566, which is incorporated by reference, which uses high shear force and some thermal cracking to reduce the viscosity of tar sands. A high shear jet reactor and high temperature reduce bitumen viscosity from 70,000 cp at 20 C. to below 200 cp. Coke formation is almost entirely avoided. The patentees focussed on asphaltene molecules, considered as grouped in layer surrounded by or immersed into maltene fluid. Rather than break up these large structures by thermal action (leading to dealkylation, cracking and coke formation), a hybrid approach was used. Some thermal disorder was introduced, followed by application of a strong shear force, such as that caused by sudden decompression in a nozzle. Fine bitumen droplets form, on the order of 30 microns, and are entrained by a highly turbulent gas jet into a thermal reactor. The reactor residence time is 1–3 seconds. Reactor effluent is cooled and separated.

In addition to the above thermal processes, which avoid feeding resid to the FCC unit, there has been some integration of resid conversion with the catalytic cracking process.

U.S. Pat. No. 4,552,645-Gartside et al taught routing the resid to a stripper/coker wherein such material is thermally cracked at high temperatures.

U.S. Pat. No. 4,422,925-Williams et al disclosed an FCC process with a low molecular weight feed introduced to the bottom of a reactor, while feeds having a higher tendency to form coke introduced near the top.

U.S. Pat. No. 4,218,306-Gross et al is assigned to the assignee of the present invention and is incorporated by reference. Gross is consistent with Williams insofar as it teaches converting relatively low coke producing gas oils in a lower part of a riser and then a higher coke producing feedstock, such as a recycle oil, in an upper section of the riser.

There is other patent literature on adding a distilled feed to the base of a riser, and a heavier feed or a resid to the top of the riser. These processes, which add the worst feed stock to the downstream (coldest) end of the riser, convert gas oils upstream of resid conversion. The catalyst is not prematurely coked by the resid, but the resid is not converted efficiently because it is added too late to the riser. Much of the resid will simply condense on the catalyst, to be burned in the regenerator, because resid is difficult to atomize, and the droplets formed vaporize slowly because resid has such a high boiling point. Another approach called for use of higher temperatures, quench technology, reviewed hereafter.

Some refiners crack resids at higher temperatures in the base of the riser, then quenching with a heat sink, such as water or a cycle oil, higher up in the riser. The higher temperatures improve vaporization, or were thought to cause instantaneous thermal cracking of the heaviest molecules into smaller molecules which could then be cracked catalytically. This approach is taught in U.S. Pat. No. 4,818,372, which is incorporated by reference. The examples cracked a hydrotreated resid and a feed with more than 65% wt % boiling above 500° C. in the base of a riser, then quenched within one second, preferably less than half a second.

In addition to cracking resids at unusually low temperatures (adding it near the top of a riser) or unusually high temperatures, refiners have also tried to find better ways to atomize all feeds. Most of this work was directed at distilled feeds, rather than resids, but the principles are the same. Perversely, as feeds become harder to atomize due to increased viscosity, the need for better atomization becomes more apparent in the FCC riser.

FEED ATOMIZATION

Refiners have long known that feed atomization, even in the base of an FCC riser reactor cracking a distillable feed, is a problem. It is difficult to contact many tons per hour of hot, regenerated cracking catalyst with large volumes of heavy oil feed and ensure complete vaporization of the feed in the base of the riser reactor.

Part of the problem is use of heavier feeds in FCC units. Many FCC feeds now contain significant amounts, on the order of 5-20%, of resid or nondistillable material. These materials are almost impossible to vaporize in fractionators, so vaporizing them in less than a second or so in an FCC riser reactor is a formidable task.

Feed nozzles which were perfectly satisfactory for adding a readily vaporizable feed, such as a gas oil, are no longer adequate for heavier feeds. As stated previously, the heavier feeds are harder to vaporize because of high boiling points, and harder to atomize because of high viscosity.

Efforts of refiners to improve atomization and vaporization of heavy feeds in FCC risers will be briefly reviewed.

Some of the efforts were on the catalyst side, i.e., refiners thought that feed atomization was fine, and that uneven distribution of catalyst in the riser was the problem. The use of lift gas to lift smooth catalyst up into the riser will usually improve feed vaporization. Other approaches assumed that catalyst distribution will be poor and forced oil distribution (via multiple nozzles) to be equally poor.

Other efforts focussed on poor atomization. Increased steam addition is common practice for dealing with heavier feeds. Although some improvement in feed dispersion is usually achieved, there is increased sour water production and other problems. Some refiners add around 5 wt % dispersion steam, when processing feeds with 5-10 wt % residual fractions. The steam helps atomize the resid, but up to half of the riser and main column volume is occupied by steam.

Refiners tried better nozzle designs. A good overview of developments in nozzles is presented in "Fluid Catalytic Cracking Report: 50 Years of Catalytic Cracking"; A. A. Avidan et al, *Oil & Gas Journal*, Jan. 8, 1990, at page 50. Open pipe or slotted, impact, spiral and critical venturi nozzles have all been tried.

The open pipe or slotted nozzle gives coarse irregular droplet sizes and is not good for injecting heavy feeds into an FCC riser reactor.

Critical venturi nozzles, where an oil and steam mixture pass through a critically sized venturi section into a larger, intermediate chamber and are discharged through a restricted nozzle can achieve very small droplet sizes. These droplets can be completely vaporized in less time than the droplets produced by spiral nozzles, but such venturi nozzles develop a narrow spray pattern. The high exit velocities of such nozzles can cause excessive catalyst attrition and may penetrate across a riser and cause erosion of the riser refractory lining.

Use of high velocity steam (1000 to 1800 ft/sec) to atomize a low velocity oil stream (20 to 50 ft/sec) was disclosed in U.S. Pat. No. 3,654,140, incorporated by reference. The high velocity steam imparts energy to the low velocity liquid.

Although there are myriad nozzle designs, many of which are unique and hard to classify, they can be more or less arbitrarily classified as relying on one or more of the following mechanisms for drop formation.

Restriction/Expansion is the most widely used form of FCC feed nozzle. A mixture of 1-5 wt % atomizing steam and the heavy, preheated feed, pass through a slot or circular orifice to form a spray. FIGS. 1 and 2 are of this type.

Mixing/Expansion involves use of swirl vanes followed by an orifice.

Shearing atomizes liquid by peeling off a thin sheet of the nozzle feed stream which spontaneously breaks into small droplets. Spiral FCC feed nozzles are examples.

Gas jet nozzles pass an atomizing gas stream through multiple orifices to strike a liquid stream. The Lechler nozzle is a good example of this type of nozzle.

Impingement nozzles atomize by the high velocity impact of a liquid on a solid surface. The Snowjet nozzle is of this type.

In FCC units, the nozzles must also be robust and reliable, as run lengths of one or two years or more are common.

To summarize the state of the art, refiners either convert resids thermally, and achieve limited conversion and/or poor quality products, or convert resids catalytically in an FCC unit, with only limited success. Resid feeds are simply too viscous, and too hard to atomize in an FCC reactor to permit their efficient conversion.

I wanted a better way to handle these difficult feeds. I realized that the other approaches either did too much or too little. Simply coking heavy feed is a waste. Conventional FCC processing, with known nozzles, was not satisfactory. I found a clue on a better FCC feed pretreatment process in the CanMet thermal process. I realized that heavy resid feeds could be converted by a combination approach, involving limited thermal and mechanical disruption of large molecules in the base of a riser reactor, or just upstream of it, to create from a resid feed a fluid having for a fleeting period properties closer to those of conventional distillable FCC feeds. I developed an FCC process and apparatus which could:

1. Avoid the agonizing slow start of resid cracking in conventional FCC units, with its difficult atomization and slow vaporization, which allowed the catalyst to coke before much of the resid vaporized.

2. Atomize the heaviest portions of the feed using vapor velocities which could not be tolerated in an FCC riser 3. Heat the resid feed to extraordinary temperatures without coking up the resid feed preheater.

4. Recover much of the energy of feed atomization (high pressure gas and liquid) and put it to good use in the FCC process.

BRIEF SUMMARY OF THE INVENTION

Accordingly, the present invention provides a dual feed injection catalytic cracking process for converting a relatively light feed containing at least 90 wt % distillable hydrocarbons and a heavier resid feed containing at least 10 wt % hydrocarbons boiling above 1000° F. and complex, disruptable species selected from the group of stacked asphaltene molecules and stacked porphyrins, to catalytically cracked products including at least 40 LV % C5 to 400° F. gasoline having an octane number of at least 90.0 RONCL in a single riser reactor having a base and an upper outlet comprising pressurizing said resid feed by mixing therewith sufficient compressed vapor to produce a resid/vapor mixture having a pressure above about 200 psig; mechanically disrupting said pressurized resid feed by discharging said resid through a high pressure drop nozzle into an expansion chamber operating at a pressure of 1 to 100 psig, with a delta P across said nozzle of at least 200 psi, and an exit velocity above 300 fps to produce mechanically disrupted feed; thermally treating said disrupted feed in said expansion chamber at a temperature above 700° F. for 0.01 to 1.0 seconds to thermally crack said mechanically disrupted feed to produce a mechanically disrupted and thermally cracked resid feed in an expansion region at a pressure of 1 to 100 psig; discharging said mechanically disrupted and thermally treated resid from said expansion region into a base section of a riser catalytic cracking reactor having said base section and an upper outlet section, said riser reactor operating at a pressure below said expansion region; charging a stream of hot, regenerated cracking catalyst from a catalyst regenerator to said base section of said riser reactor and thermally and catalytically cracking said resid in a resid cracking zone in a lower portion of said riser by contact with said hot, regenerated cracking catalyst; charging said relatively light feed to said riser reactor at a location downstream of said resid cracking zone; catalytically cracking said relatively light feed and said thermally treated, mechanically disrupted resid feed in said riser reactor at catalytic cracking conditions including a cat:feed weight ratio of a least 4:1, a catalyst and combined vaporized feed initial mixture temperature of 950° to 1100° F., to produce a mixture of catalytically cracked products and spent cracking catalyst which are discharged from said outlet of said riser reactor; separating said discharged mixture of catalytically cracked products and spent cracking catalyst into a cracked product rich vapor phase, which is withdrawn as a product, and a spent catalyst rich phase; stripping said spent catalyst in a stripping means at stripping conditions to produce stripped catalyst; regenerating said stripped catalyst in a catalyst regeneration means operating at catalyst regeneration conditions to produce hot regenerated cracking catalyst which is recycled to the base of said riser reactor.

In another embodiment the present invention provides a fluidized catalytic cracking process wherein a heavy feed having a viscosity and containing stacked hydrocarbon structures selected from the group of stacked asphaltenes or stacked porphyrin structures boiling above 1000° F. is catalytically cracked in a riser cracking reactor means to produce cracked products and spent catalyst, spent catalyst is stripped in a stripping means and regenerated in a catalyst regeneration means to produce hot regenerated catalyst which is recycled to said riser reactor, characterized by use of at least one multi-stage atomizing feed nozzle to inject feed in a base portion of said riser reactor, said nozzle comprising a pressurizing section wherein a gas, which is at least partly soluble in hydrocarbons and has a greater solubility in hydrocarbons at 500°-800° F. than nitrogen, contacts said hydrocarbon and is at least partially dissolved in said hydrocarbon to produce a gas/-liquid mixture having a pressure of 100 to 2000 psig and containing dissolved gas; an expansion section wherein pressure of said pressurized mixture is reduced within less than 0.01 seconds to no more than 30% of the pressure in the pressurizing section and sufficient to cause at least a 3 fold expansion of the gas liquid mixture, atomize the liquid, cause at least a portion of the dissolved gas to come out of solution and mechanically disrupt stacked structures in said liquid, thermally crack said heavy feed by providing a time and temperature in said expansion region, as measured by Equivalent Reaction Time at 800° F. (ERT) of 5 to 500 ERT seconds, and produce an atomized, thermally cracked liquid feed containing disrupted stacked hydrocarbon structures with a reduced viscosity relative to said viscosity of said feed, and a riser injection section, wherein said atomized, disrupted liquid is injected into said riser reactor.

DESCRIPTION OF THE PREFERRED EMBODIMENTS

PRIOR ART FCC FEED NOZZLES

Figure 1:
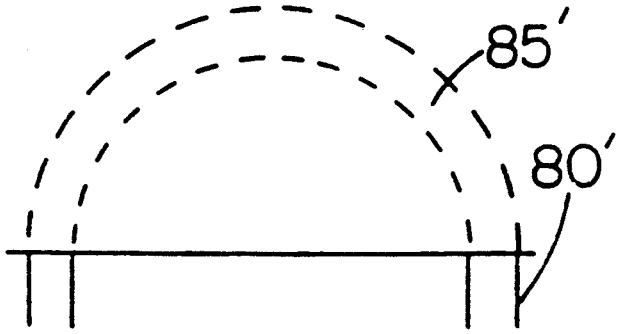
FIG. 1 PRIOR ART
FIG. 1 and FIG. 2 (prior art) show different views of a 180 degree slotted cap nozzle outlet.
Figure 2:
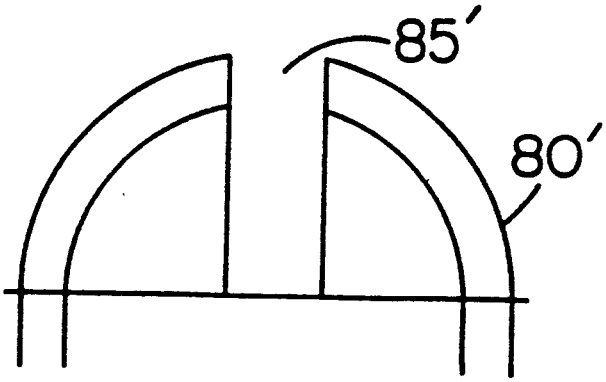
FIG. 2 PRIOR ART

The state of the art in regard to FCC feed nozzles, or at least feed nozzle outlets, is represented by FIGS. 1 and 2. The end of the nozzle 80', with notch or slot 85', sprays liquid feed into FCC risers. The feed upstream of the nozzle is an atomized mixture of steam, or other atomizing fluid, and liquid hydrocarbon feed, usually with a minor amount of vaporized hydrocarbon. The slot orifice 85' is usually a cut out or ground out portion of the end cap 80'. Typically the slot orifice has 180° opening, and has a width or open portion equivalent to 15-50% of the diameter of the pipe or end cap 80' containing the slot orifice.

The slot develops a fan shaped spray, which is preferred for side mounted nozzles. For vertical use, i.e., when one or more nozzles are mounted vertically in the base of a riser, then a conventional round orifice outlet will usually be preferred.

In these nozzles, or those shown in the Oil and Gas Journal report, oil and steam are injected into a pipe, the end of which terminates in a reduced diameter orifice. The nozzle atomizes or disperses the oil by imparting a high velocity to the oil and atomizing steam. Poor results are obtained with resid feeds. These nozzles are satisfactory when processing readily distillable feeds, such as gas oils, but their deficiencies become more evident with feeds containing more than about 5 wt % nondistillable material. The problem is that much of the liquid feed is poorly atomized. The large liquid droplets can take a long time to vaporize or may not vaporize at all and form coke. In some units the feed is not vaporized until after the catalyst is significantly deactivated.

The present invention preferably isolates the worst of the feed and uses several mechanisms to improve its crackability. This preferred, but optional distillation, and the interaction of the present invention with conventional catalytic cracking can best be understood with a review of FIG. 3.

The first stage is isolation of the worst feeds, the non-distillable feeds, from the more conventional feeds. The conventional feeds can be fed to conventional FCC feed nozzles, while the worst feeds are subjected to mechanical shattering and a degree of thermal cracking before seeing FCC catalyst. This allows the most intensive work to be done on the smallest portion of the feed to the FCC unit and the portion which had previously made it difficult to vaporize all the feed. Conventional distillation, preferably vacuum distillation, is used for this first step, much as it has been for the last 40 or 50 years in FCC processing.

Crude oil flows via line 1 to crude column 10. Conventional distillation produces streams ranging from light overhead vapor products removed via line 6, light overhead liquid products removed via line 3, to a naphtha fraction removed via line 4, and a gas oil fraction removed via line 2. Non-distillables, at least those hydrocarbons not recoverable by conventional distillation at atmospheric pressure, are removed via line 5 as resid fraction.

In most refineries the resid fraction 5 is charged to a vacuum column, not shown, to produce a vacuum gas oil fraction and a vacuum resid. This produces more distilled feed for the FCC unit, and reduces the size of the resid stream. For simplicity, the present invention shows the crude distillation column and omits the vacuum column.

The FCC unit comprises FCC riser 100, FCC reactor disengaging vessel 20 (primarily a spent catalyst/-cracked product separator, although still referred to sometimes as a reactor), regenerator 30, and FCC main column 40.

There are two feed systems to the base of the riser and two feed injection systems. The gas oil feeding system, involving line 2 and conventional nozzles shown schematically as the resid feed in line 5, is mixed with pressuring vapor from line 72 and the resulting mixture charged via line 74 to asphaltene shattering nozzle 75. The resid feed in line 5 will usually be very hot as it comes from the bottom of the crude column or from the vacuum column not shown. It may be beneficial to pass the resid feed through some sort of heating means, such as a fired heater not shown. Usually the resid will be hot enough as it comes from the column to permit its use herein. The resid feed will usually be sent through one or more stages of pumping to reach the pressure desired, as the pressure in the bottom of the column, not even on the discharge side of the reboiler pumparound circuit, will usually not be adequate. Adding more head to liquid streams by pumping is common technology and need not be shown.

Preferably, the resid is heated just upstream of the resid shattering nozzle by the same gas used to pressurize this stream. A high pressure gas, preferably hydrogen, is charged via line 68 to a heating means such as fired heater 70 to produce a superheated, compressed vapor stream in line 72. A temperature control means, not shown in line 74 or in the shattering nozzle 75, may be used to monitor and control the temperature of the resid/vapor mixture charged to the shattering nozzle. One acceptable control method is control of the temperature or flow rate, or both, of gas in line 72 so enough thermal energy is added to the combined stream to heat it to the desired level.

The gas oil, or vacuum gas oil, is charged via line 2 to the conventional nozzle 45 in the base of riser reactor 100. Hot regenerated catalyst flows from regenerator 30 via line 32 to the base of the riser 100.

Both feeds and hot catalyst pass up the riser. Cracked products and spent catalyst enter FCC reactor 20 where little reaction occurs. Spent catalyst is separated from cracked products by conventional means. Spent catalyst is stripped in a catalyst stripping means within vessel 20, then charged via line 24 to FCC regenerator 30. Regeneration air is added via line 34. Coke is burned from spent catalyst in the regenerator, producing flue gas removed via line 36 and hot regenerated catalyst recycled via line 32 to the base of riser reactor 100.

Hot cracked product withdrawn from vessel 20 passes via line 26 to the base of the FCC main column 40 which operates conventionally. Trays or packing fractionate the cracked product vapor into a main column bottom stream 42, sometimes called a slurry oil, one or more cycle oil products, such as a light cycle oil or LCO product withdrawn via line 55, a heavy naphtha stream withdrawn via line 47, a light naphtha stream withdrawn via line 43, and an overhead vapor stream withdrawn via line 46. Light liquid reflux returns to the column via line 58.

The heavy naphtha fraction may be removed as a product via line 47 or recycled by means not shown for use as quench in the riser reactor.

Figure 3:
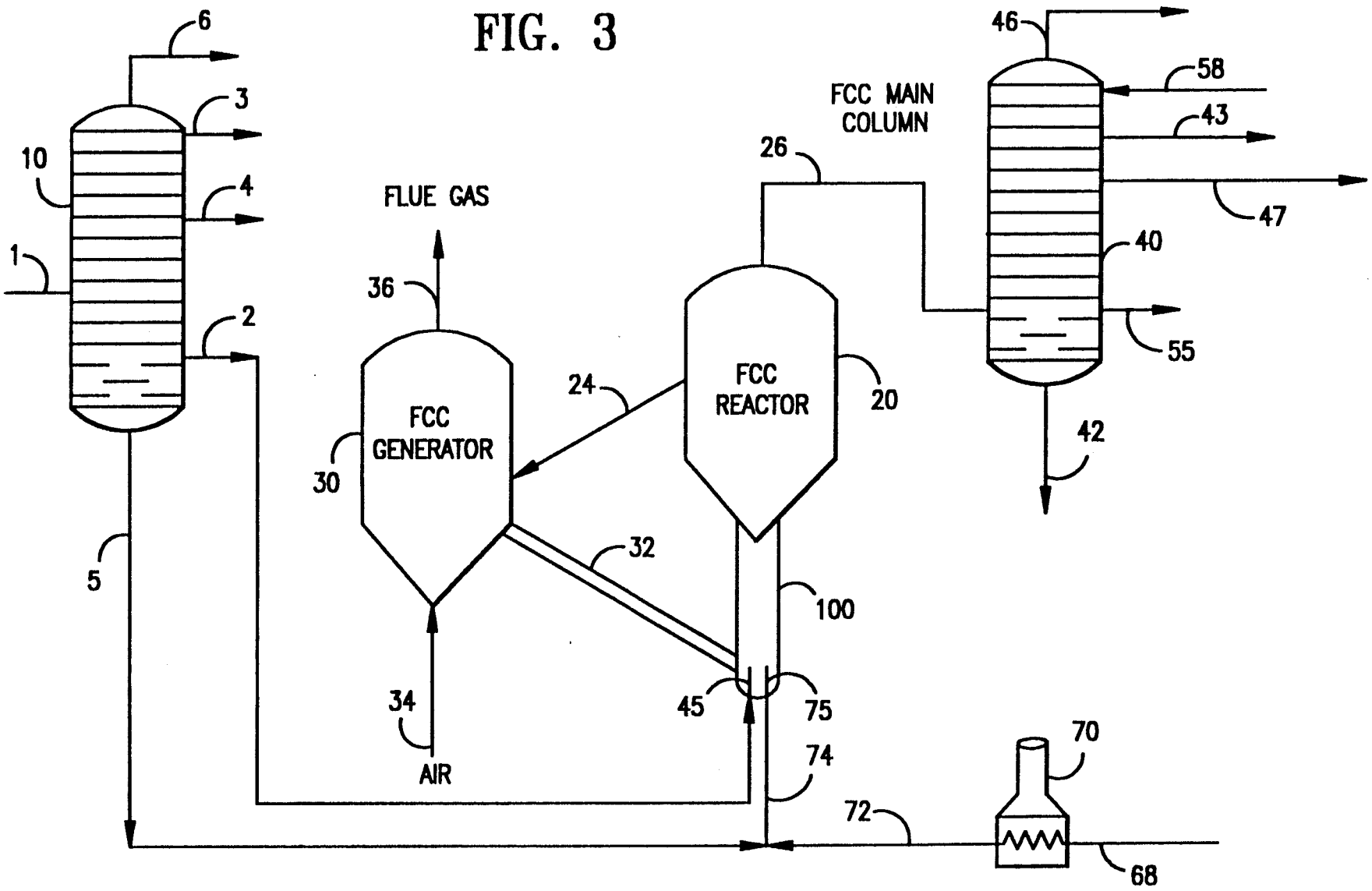
FIG. 3 shows a conventional riser cracking FCC with an asphaltene shattering section in the base of the riser.

The FIG. 3 embodiment will be the easiest to implement in most refineries with vertical nozzles in the base of the riser. A mix of nozzles can be used, some relatively large asphaltene shattering nozzles (large to provide residence time and reduce vapor velocity from the high dP nozzle) and smaller conventional feed nozzles for the distilled feeds. Because of the relatively large size of the nozzles of the present invention, it may be beneficial to reserve the base of the riser for the resid rich feed, while adding the lighter feeds higher up in the riser, preferably via a plurality of radially distributed nozzles. The reasons for this can be better understood by considering the size of the nozzles of the invention (as shown in FIG. 4 discussed hereafter) and the size of the conventional nozzles and riser reactors (as shown in FIG. 5 discussed hereafter).

ASPHALTENE SHATTERING NOZZLE

Figure 4:
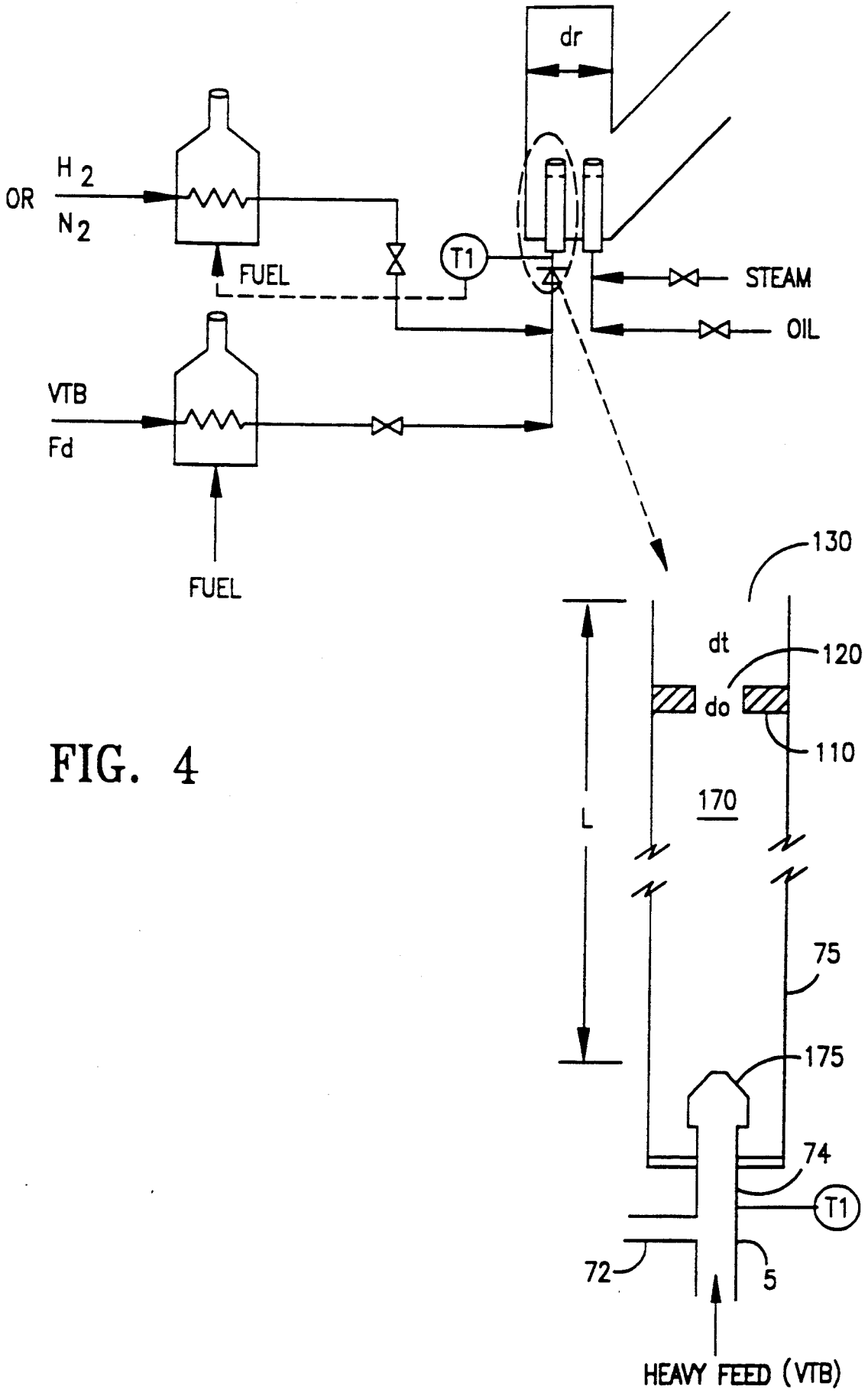
FIG. 4 shows a cross sectional view of a preferred mechanical shattering nozzle.
Figure 5:
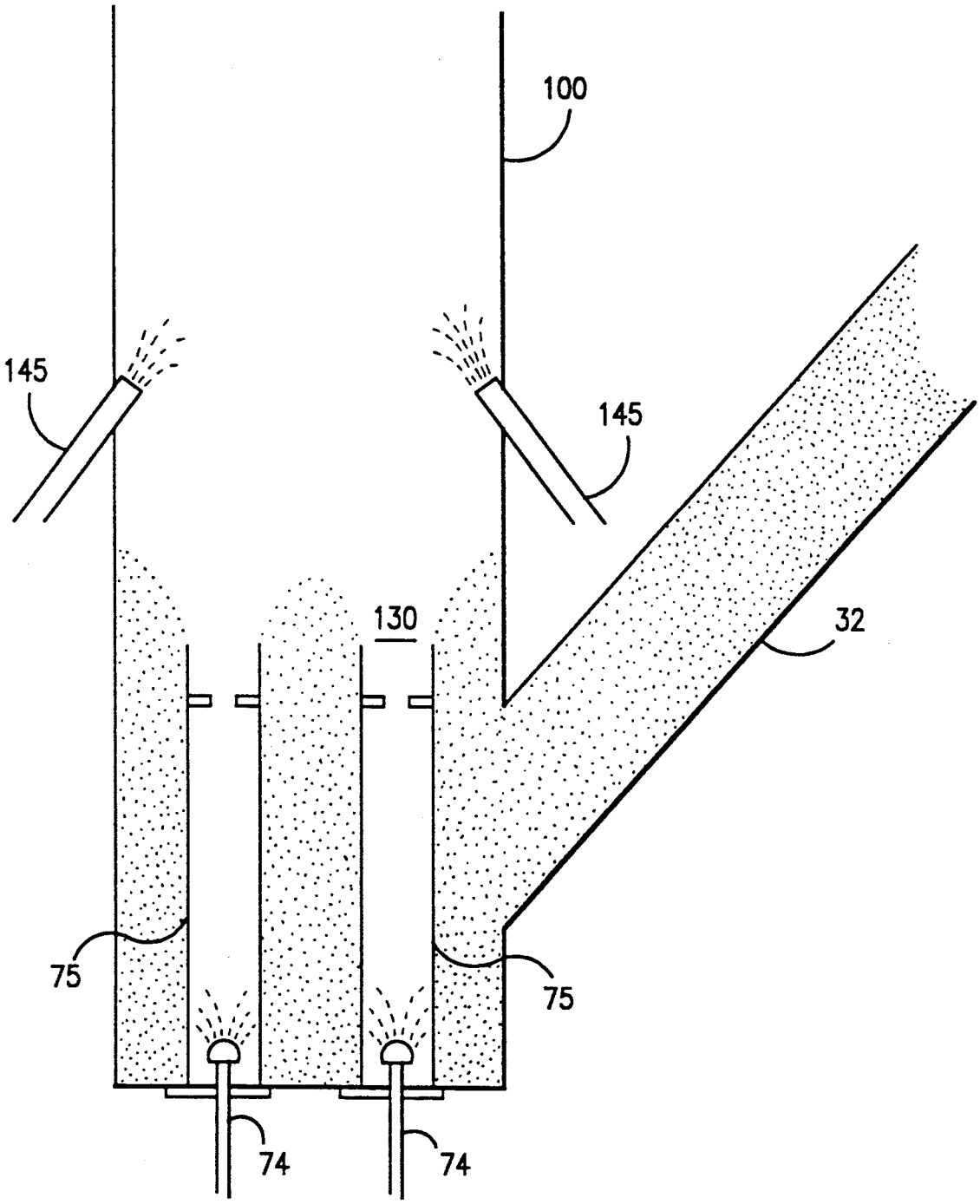
FIG. 5 shows a preferred configuration, with a central shattering nozzle for a resid feed in the base of a riser, and radially distributed conventional nozzles for a distilled feed higher up in the riser.

FIG. 4 shows a preferred configuration for an asphaltene shattering nozzle. Briefly, nozzle 75 comprises an initial V/L mixing section 74, a high pressure drop nozzle 175, an expansion section 170 and a preferred but optional orifice tip outlet means 120.

INITIAL V/L MIXING

The heavy liquid feed is charged via line 5 to mix with pressurizing vapor, preferably superheated hydrogen, from line 72. The vapor and liquid mix in region 74 are charged to atomizing nozzle 175. This nozzle is designed to operate with an extremely large pressure drop, well over 100 psi, and preferably in the range 500 to 1000 psi or higher. A well atomized, high velocity spray of heavy oil and atomizing vapor is discharged into the expansion region 170. The atomized mixture preferably impinges against the barrel of the nozzle 75 several times, before meeting orifice 120 formed by annular ring 110. The orifice outlet forces additional atomization of oil, as any oil film or large droplets forming near the walls of region 170 will be swept back closer to the mainstream due to the orifice outlet. Preferably the nozzle barrel extends some distance past the orifice outlet, in region 130, to allow for radial expansion of the atomized stream discharged from the orifice and a reduction in its velocity to minimize catalyst attrition. Although a barrel region downstream of the orifice outlet is preferred, it is not essential, and the asphaltene shattering nozzle of the invention may simply end with an orifice outlet 120 as do most conventional orifice nozzles.

The total length of the nozzle barrel or tube L will usually be set to provide the desired hydrocarbon residence time. The diameter of the tube (d tube) will be sized based on conventional sizing criteria, e.g., the diameter of the orifice (d orifice) will usually be sized to give a modest pressure drop, preferably at least an order of magnitude less pressure drop as compared to the Dp across nozzle 175. In many installations, the orifice will be sized to give a pressure drop of 10 to 50 psi, and preferably of about 15–25 psi. A higher pressure drop orifice outlet will increase the pressure within region 170, and increase the residence time and thermal cracking achievable within region 170. Higher pressure in region 170 will also reduce the pressure drop, or amount of expansion, across nozzle 175.

Although an expansion section or region 170 is essential (for residence time and reduction in vapor velocity), it is not essential that all this hardware be physically within the riser reactor. Many units, because of site constraints, will not be able to mount large vertical nozzles such as the ones shown without undue modifications, and for these units the expansion region can be outside the riser reactor and need not be vertical. Thus, the initial atomization across the high pressure drop nozzle and the expansion can occur in a horizontal, or tilted, pipe external to the reactor with only a minor portion or the expansion region 170 being within the riser. In an extreme case, only the outlet region 130 need be in the riser reactor with the remainder external to the riser. This is possible because the velocities and pressure drops within region 170 are sufficiently high that adequate performance will be achieved even when the unit is essentially horizontal. Any coalascence or maldistribution of droplets which may occur will be rectified in passing through the orifice outlet 130.

FIG. 5 shows a simplified, cutaway view of a riser reactor with resid shattering nozzles mounted vertically in the base of the riser and radially distributed conventional feed nozzles higher up in the riser. The figure is roughly to scale, at least as far as the relative sizes of the nozzles and the riser.

A mixture of resid and atomizing gas is charged via line 74 into asphaltene shattering nozzles 75. In practice 1–8 nozzles might be used, but only two are shown for simplicity. The nozzles would be about 10' long, i.e., the distance from the base of the nozzle barrel to the outlet region 130 is 10'. The nozzle barrel is sized to limit exit velocity to <350 fps. It will usually be made from a length of schedule 180 pipe, mounted on a flange so oversized holes can be used to stab the nozzles into the base of the riser. (Most riser reactors will not have 10' of clearance between grade level and the base of the riser; the nozzles will have to be initially inserted at an angle).

The nozzle outlets are preferably located at an elevation ranging from just above the point where the base of the inlet line 32 contacts riser 100 to a point at or just slight above the point where the top of the inlet line 32 contacts riser 100. More preferably, the nozzle outlets are located from 20 to 110% of the apex, or the opening of the standpipe into the riser.

The ID of the riser reactor shown is about 42 inches, while the ID of the catalyst return line 32 is about 38 inches. The conventional feed is injected through a plurality of radially distributed nozzles mounted further up the riser, typically 5–10 feet above the apex. This will require installation of new feed nozzles, as most FCC risers will not have feed nozzles of this size 15–20' up from the base of the riser, but such modifications are easy to do because the riser 100 is exposed and relatively easy to reach.

This unusual configuration provides three stages of conversion of resid feeds, summarized below (along with my theory as the underlying conversion mechanism at each stage):

1. Mechanical shattering and thermal "softening" in nozzles 75, creates a reduced viscosity feed with properties much closer to those of vacuum gas oil. (Large, stacked asphaltene structures are at least momentarily broken up, but will soon reconnect if given the chance.) When hydrogen is used as the pressuring gas, this will promote hydrovisbreaking of asphaltenes which aids in their vaporization.
2. Complete vaporization and catalytic cracking in the base of the riser is achieved by forcing the hottest catalyst to see the heaviest feed. A significant amount of the resid is thermally and catalytically cracked at conditions which could not long be tolerated in a riser reactor. (The reduced viscosity and small size droplets can be vaporized within 10' of travel up the riser. Disrupted asphaltene structures have access to almost an order of magnitude more catalyst surface area and heating than in prior art processes.)
3. Conventional cracking of shattered, thermally, and catalytically cracked resid is achieved in the upper portions of the riser, with the rest of the conventional gas oil feed. The resid has been cracked down to something approaching a VGO, while the virgin VGO feed is not overcracked.

The resid and gas may be mixed upstream of the FCC unit and the combined stream sent through a preheater. Because of the high temperatures involved and the high coking tendency of the extremely heavy feeds contemplated for use herein, it is highly preferred to preheat these two streams separately and use superheated vapor to accomplish the final heating of the resid or vacuum resid or tar sands feed.

HIGH PRESSURE DROP NOZZLE

The mixture of heavy feed and vapor enter an atomizing nozzle designed to develop a pressure drop of at least 1000 psi, preferably at least 500 psi, and most preferably at least 1000 psi. When the liquid feed passes through such a nozzle, the rapid expansion and intense mechanical shearing will mechanically disrupt large molecular structures making up the resid.

Preferably very high nozzle velocities are achieved, even approaching sonic velocity. Such velocities could not be tolerated in conventional FCC units, as they would cause undue catalyst attrition and might erode the riser. The considerable mechanical energy in the stream discharged from the high pressure drop nozzle is used to disrupt asphaltenes, preferably by letting this stream bounce back and forth in the expansion section.

EXPANSION SECTION

The preferred expansion section serves several functions. It provides a large cross-sectional area and sufficient open volume, so that rapid expansion and decompression of heavy feed may be achieved, somewhat independently of what is going on in the rest of the riser reactor.

The expansion section is preferably cylindrical, with a length to diameter ratio of at least 4:1. Preferably the expansion section has a cross sectional area, in a direction normal to the high pressure drop nozzle outlet, from 5 to 50 times the cross sectional area of the high pressure drop nozzle outlet.

The expansion section volume also provides time for the high temperature hydrocarbon stream to crack thermally. A modest amount of thermal conversion or visbreaking may be achieved during expansion. A limited amount of thermal conversion is helpful in that many large molecules are not cracked at all or are cracked only slowly by the large pore zeolites used in the FCC reactor. Limited thermal cracking, or hydrovisbreaking, is believed to produce transient, short-lived hydrocarbon species which are more easily converted to lighter products. Others have suggested severe preheat, as by using visbreaking to preheat FCC feed as a way to improve the crackability of heavy feeds. I believe this visbreaking effect helps, and a limited amount of visbreaking can be provided in the expansion section by sizing it sufficiently large to provide up to about 1 or 2 seconds of residence time.

Preferably, the expansion section is sized to provide from 0.01 to 1.0 seconds of hydrocarbon residence time, more preferably from 0.05 to 0.8 seconds of residence time and most preferably from 0.1 to 0.5 seconds of residence time.

The lower limit on residence time will usually be set by the volume of the expansion section needed to permit expansion of the feed from its highly compressed state (typically 500 to 1000 psia or higher) to pressures approaching those in an FCC riser reactor or within 10 to 25 psi of those in a riser reactor.

The pressure in the expansion region is preferably from 5 to 60 psig and more preferably from 10 to 50 psig. The pressure in the high pressure or pressurizing section of the high pressure drop nozzle is preferably from 500 to 1500 psig. The process works well when a resid is heated and pressurized with C4-hydrocarbons, and the delta P across the nozzle is 500–1500 psi.

The upper limit on residence time will usually be set by economics, feed characteristics, the availability of a suitable gas, compression costs, and myriad other factors. I do not want to achieve any more than minimal conversion of heavy feed by visbreaking as thermal cracking is a process of last resort. I want to maximize conversion by catalytic cracking. A limited amount of thermal cracking improves the cracking characteristics of the feed and reduces its viscosity; the heavy feed is at least easier to vaporize in the riser reactor. Extended thermal cracking produces coke and dry gas, both of which are low value products and the reason why thermal cracking is minimized.

When mechanical shattering of asphaltenes or other large molecular species such as porphyrins must be limited because of constraints imposed by the availability of a suitable atomizing gas or downstream constraints, then it will usually be best to compensate with a longer residence time in the expansion region. This allows thermal cracking to complete the conversion of mechanically disrupted species or perhaps of species which have not been mechanically disrupted.

When only limited thermal cracking is needed, the volume of the expansion region can be reduced to that needed to permit free expansion from the high pressure drop nozzle into the expansion region.

I am not sure of the precise reaction mechanism by which the viscosity of heavy hydrocarbon species is reduced. I know that temperature alone can reduce the viscosity of residual hydrocarbons, and there can be a short-lived enhancement of the crackability of heavy feeds due to thermal reactions. I know that the viscosity of heavy feeds can be reduced by intense mechanical agitation and believe this is also a short lived phenomenon. I am not sure if the same molecules are altered by both treatments but believe many of the molecules which are most disruptable by mechanical forces are also readily decomposed by time and temperature. It is also possible that mechanical disruption merely disturbs stacked asphaltene molecules, while thermal cracking breaks off alkyl side chains, or vice versa.

It is fairly easy to calculate thermal severity, and this is discussed more fully in the next section. There are no published correlations available relating viscosity reduction of tar sands or resids. Many people have observed short lived, or permanent, viscosity reduction in thick fluids, ranging from ketchup (a thixotropic fluid, which recovers its original viscosity after a few seconds) to drilling fluids (some permanently lose viscosity is passed through a pump) to tar sands (the Canmet work using a high shear jet reactor). Fortunately, it is not necessary to know the precise mechanism of shear disruption nor develop generalized correlations. All FCC units operate just slightly above atmospheric pressure, and specifying a total delta P across the feed shattering nozzle adequately defines the severity required for mechanical disruption of the complex large structures making up resids and tar sands.

The threshold delta P, at which some disruption of large molecular species starts to occur, is believed to be about 100 psi, but in practice I prefer to operate with at least 200 psi delta P, more preferably with at least 500 psi delta P, and most preferably over 1000 psi delta P. These numbers can be reduced somewhat if a significant amount of depressurization occurs when the atomized feed is discharged into the riser reactor, i.e., some shattering can occur as the feed expands into the FCC riser. Usually this expansion will be minimal, as the high nozzle discharge velocities needed for mechanical disruption of large hydrocarbon molecules also leads to attrition of FCC catalyst.

THERMAL CRACKING

Thermal reaction severity can be well-defined using the concept of equivalent reaction time at some arbitrary temperature, usually 800° F. This concept was originally developed to allow comparison of one Visbreaker operating at 800° F. with 1000 seconds of residence time (=ERT of 1000 seconds) with another one operating at 820° F. with 500 seconds of residence time. Both operations have essentially the same thermal severity, and both will have equivalent amounts of conversion of heavy feed to lighter products.

Expressed as ERT, sufficient time and temperature in the expansion region will usually be provided to subject the heavy feed to 5 to 500 ERT seconds, preferable to 10 to 200 ERT seconds, and most preferably from 15 to 150 ERT seconds.

L/D OF EXPANSION REGION

The length to diameter ratio of the expansion region is usually set by residence time, high pressure drop nozzle spray pattern, and superficial vapor velocity limits in the FCC riser.

When using a high pressure drop nozzle with a strongly diverging spray pattern, e.g., approaching a 90° spray pattern, then a relatively large diameter expansion region can be used. Most high pressure drop nozzles develop relatively narrow spray patterns, and for these nozzles a narrower tube is preferred. The tube width should be set so the spray bounces off the tube wall at least once, and preferably 2–4 times before leaving the expansion section. The bouncing, or impingement of the high velocity stream against a solid surface, and criss-crossing of high velocity liquid streams, uses the considerable energy in the high velocity stream discharged from the high pressure drop nozzle to shear repeatedly the heavy feed.

EXPANSION SECTION OUTLET

The expansion section should end with an outlet means adapted to discharge and distribute the mechanically and thermally disrupted feed uniformly across the cross section of the riser.

A suitable sizing equation may be used such as:

$$(d_N{*}V^2{}_N{*}\mathrm{Rho}_N)/(d_R{*}V^2{}_R{*}\mathrm{Rho}_R)=2\text{–}3.$$

The exit velocity should be less than about 350 fps to avoid catalyst attrition.

QUENCH

It may be beneficial to quench the riser using conventional quench technology, e.g., recycle of heavy naphtha, LCO, or use of steam.

RISER CONDITIONS

Although conditions at the base of the riser, and in the asphaltene shattering nozzles, are far more severe than those associated with conventional FCC operations, the FCC unit at the top of the riser, and downstream of the riser, can and preferably does operate conventionally. Riser top temperatures of 950–1050 will be satisfactory in many instances.

CATALYST ACTIVITY

Conventional FCC catalyst, i.e., the sort of equilibrium catalyst that is present in most FCC units, can be used herein. Preferred catalysts are those which have a relatively high zeolite content, preferably in excess of 30 wt % large pore zeolite and preferably approaching or even exceeding 50 wt % large pore zeolite. The large pore zeolite preferably has a relatively small crystal size to minimize diffusion limitations. The zeolites should be contained in a matrix which has a relatively high activity, such as a relatively large alumina content. Especially preferred is use of a high activity matrix comprising at least 40 wt % alumina, on a zeolite free basis and having sufficient cracking activity to retain at least a 50 FAI catalyst activity. Such a bottoms cracking catalyst will help convert those large molecules which cannot fit within the pores of conventional X and Y zeolites.

The catalyst may contain one or more metal passivating agents in the matrix.

The catalyst should also be formulated to have a relatively large amount of its pore structure as large macropores. Many catalysts having at least some of these properties have been developed, primarily for cracking resids mixed with conventional feeds. These resid cracking catalysts are highly preferred for use in the process of the present invention.

THERMAL REACTIONS

The process of the present invention may be used to improve properties of the heavy products. Subjecting the resid, or a resid rich fraction, to mechanical agitation, followed by immediate thermal treatment, will reduce the viscosity of the heavy product fractions. This effect is in addition to increased conversion, i.e., conversion to lighter products will be achieved by practicing this invention, and the properties of the heavy fuel oil will be improved to some extent by viscosity reduction.

Conventional techniques can be used to calculate or estimate the amount of thermal reaction that occurs in the resid shattering nozzle. There will be some additional "visbreaking" when the FIG. 5 embodiment is practiced, but the ERT in this region is harder to calculate because of many complications—vaporization, endothermic catalytic and thermal reactions, and short lived effects due to mechanical disruption.

In general, it is believed beneficial to achieve thermal conversion of resid equal to roughly 5 to 500, and preferably 10 to 200 ERT seconds in the shattering nozzle. It will be beneficial to have a similar, or even somewhat greater, amount of ERT conversion in the base of the riser (FIG. 5 embodiment) prior to introduction of conventional gas oil or VGO feeds. This will provide enough thermal cracking in the base of the riser to generate heavy "cutter stock" which will significantly reduce the viscosity of the heavy fuel oil product.

ADDITIVE CATALYSTS

In many instances it will be beneficial to use one or more additive catalysts, which may either be incorporated into the conventional FCC catalyst, added to the circulating inventory in the form of separate particles of additive, or added in such a way that the additive does not circulate with the FCC catalyst.

ZSM-5 is a preferred additive, whether used as part of the conventional FCC catalyst or is the form of a separate additive. The ZSM-5 can be added as large, fast settling particles, which have an extended residence time in the riser. High silica additives, such as ZSM-5, do not deactivate nearly as quickly as the conventional catalyst in the riser, so they make highly desirable additives for use in the process of the present invention.

FEED COMPOSITION

The present invention is applicable for use with all FCC feedstocks. The feeds to the asphaltene shattering nozzles which will benefit most from the practice of the present invention are similar to those described in U.S. Pat. Nos. 4,818,372 and 4,427,537—namely, those feed which contain at least 10 wt % material boiling above about 500° C., and preferably those which contain 20, 25, 30% or more of such high boiling material. Especially beneficial results are seen when the heavy feed contains 50 wt % or more material boiling above 500° C. A highly preferred chargestock comprises a mixture containing at least 50 wt % resid, perhaps diluted or mixed with a minority of a lighter, less viscous chargestock, such as a gas oil, a vacuum gas oil, or even a heavy naphtha material.

A mixture of resid, and conventional FCC recycle streams, such as light cycle oil, heavy cycle oil, or slurry oil, can also be used. In this instance, the FCC recycle stream acts primarily as a diluent or cutter stock whose primary purpose is to thin the resid feed, to make it easier to pump and to disperse into the asphaltene shattering nozzles.

RESID FEED/VGO FEED RATIOS

The process of the present invention requires two feeds which can be conveniently referred to as a resid feed (although it might be tar sands, etc) and VGO (or any other feed which is easier to crack than the heavy feed). The terms are illustrative, not limiting. "VGO" could be a whole crude, an easy to crack atmospheric resid, deasphalted oil, etc.

The VGO feed should be as large a stream, on a molar or on a weight basis, as the resid feed. Preferably, the VGO feed is present in an amount equal to 100 to 1500 wt % of the resid feed, more preferably 150 to 1000 wt % and most preferably 200 to 750 wt % of the resid feed. This allows extreme conditions to be used on the worst feed, e.g., use of 5 to 10 times as much atomizing gas by volume as could be tolerated in a conventional FCC unit.

The ratios can be most easily understood by considering what happens if atomizing steam is used either on the whole FCC feed (prior art) or used as the shattering vapor in the resid nozzles and used conventionally to help atomize a VGO feed. Atomizing steam is not the preferred atomizing gas (hydrogen, or light ends from the gas plant are preferred), but it is a commonly used one and lends itself to illustrative calculations. Two cases will be considered, a prior art case, using large amounts of steam to help atomize a heavy feed, and a case using split feed (invention).

Prior Art: For 100 kg of feed containing 5 wt % CCR, a refiner might use as much as 5 kg or 5 wt % of atomizing steam in an attempt to cope with such a difficult feed.

Invention: In my process, the bottom 10% of this feed would be isolated. There would be two feeds, 90 kg of VGO with essentially no CCR, and 10 kg of a resid fraction w/50 wt % CCR. The 10 kg of resid is charged to the FCC riser via resid shattering nozzles, with 4 kg of steam. 10 kg of resid sees 4 kg of steam. This is an extraordinarily large amount of steam, equal to 40 wt % of the resid feed. No refinery in the world operates with anything approaching 40 wt % steam.

The VGO, the lightest 90 wt % of the feed, could be atomized with 1 kg of steam. This is on the low side of conventional (most refiners add 1 to 2 wt % dispersion steam) but is acceptable and especially so as the steam from the resid shattering nozzles will perform some of the functions of dispersion steam.

Using the process of the present invention, the total amount of steam can be exactly the same, but that portion of the feed which needs the most severe treatment will "see" almost an order of magnitude more atomizing steam than the VGO.

Expressed as a weight ratio of relatively heavy feed (resid) to light feed boiling above 650° F. (VGO) added higher up in the riser, the weight ratio is preferably at least 5:1, and more preferably at least 10:1.

DISCUSSION

It will be recognized by those skilled in the art that the process of the present invention calls for an unusual operation of the FCC unit. An FCC unit of the present invention can achieve a significant amount of visbreaking of heavy feed, with essentially none of the capital or operating expenses of a visbreaker. No separate visbreaker heater is required; there is no fractionator associated with the visbreaker and no production of relatively low value products, such as the thermally cracked gasoline usually produced by a visbreaker.

Although the invention has been described for riser reactors, which are in widespread use commercially, the process also works with equal effectiveness in a downflow reactor.

I claim:

1. A dual feed injection catalytic cracking process for converting a relatively light feed containing at least 90 wt % distillable hydrocarbons and a heavier resid feed containing at least 10 wt % hydrocarbons boiling above 1000° F. and complex, disruptable species selected from the group of stacked asphaltene molecules and stacked porphyrins, to catalytically cracked products including at least 40 LV % C5 to 400° F. gasoline having an octane number of at least 90.0 RONCL in a single riser reactor having a base and an upper outlet comprising;

a. pressurizing said resid feed by mixing therewith sufficient compressed vapor selected from the group consisting of steam, hydrogen, and normally gaseous hydrocarbons, to produce a pressurized resid feed of a resid/vapor mixture having a pressure above 200 psig;

b. mechanically disrupting said pressurized resid feed by discharging said resid through a high pressure drop nozzle into an expansion chamber operating at a pressure of 1 to 100 psig, with a delta P across said nozzle of at least 200 psi, and an exit velocity above 300 fps to produce mechanically disrupted feed;

c. thermally treating said disrupted feed in said expansion chamber at a temperature above 700° F. for 0.01 to 1.0 seconds to thermally crack said mechanically disrupted feed to produce a mechanically disrupted and thermally cracked resid feed in an expansion region at a pressure of 1 to 100 psig;

d. discharging said mechanically disrupted and thermally cracked resid from said expansion region into a base section of a riser catalytic cracking reactor having said base section and an upper outlet section, said riser reactor operating at a pressure below said expansion region;

e. charging a stream of hot, regenerated cracking catalyst from a catalyst regenerator to said base section of said riser reactor and thermally and catalytically cracking said resid in a resid cracking zone in a lower portion of said riser by contact with said hot, regenerated cracking catalyst;

f. charging said relatively light feed to said riser reactor at a location downstream of said resid cracking zone;

g. catalytically cracking said relatively light feed and said, mechanically disrupted and thermally cracked resid feed in said riser reactor at catalytic cracking conditions including a cat:feed weight ratio of a least 4:1, a catalyst and combined vaporized feed initial mixture temperature of 950° to 1100° F., to produce a discharged mixture of catalytically cracked products and spent cracking catalyst which are discharged from said outlet of said riser reactor;

h. separating said discharged mixture of catalytically cracked products and spent cracking catalyst into a cracked product rich vapor phase, which is withdrawn as a product, and a spent catalyst rich phase;

i. stripping said spent catalyst in a stripping means at stripping conditions to produce stripped catalyst;

j. regenerating said stripped catalyst in a catalyst regeneration means operating at catalyst regeneration conditions to produce hot regenerated cracking catalyst which is recycled to the base of said riser reactor.

2. The process of claim 1 wherein the delta P across said nozzle is above 500 psi.

3. The process of claim 1 wherein the delta P across said nozzle is 200 to 500 psi.

4. The process of claim 1 wherein the pressure in the expansion region is 5 to 60 psig.

5. The process of claim 1 wherein the pressure in the expansion region is 10 to 50 psig.

6. The process of claim 1 wherein the weight ratio of resid to relatively light feed is at least 5:1.

7. The process of claim 1 wherein the weight ratio of resid to relatively light feed is at least 10:1.

8. The process of claim 1 wherein said resid is heated and pressurized with C4-hydrocarbons, and the delta P across said nozzle is 500–1500 psi.

9. A fluidized catalytic cracking process wherein a heavy hydrocarbon feed having a measured viscosity and containing stacked hydrocarbon structures selected from the group of stacked asphaltenes and stacked porphyrin structures boiling above 1000° F. is catalytically cracked in a riser cracking reactor means to produce cracked products and spent catalyst, spent catalyst is stripped in a stripping means and regenerated in a catalyst regeneration means to produce hot regenerated catalyst which is recycled to said riser reactor, characterized by use of at least one multi-stage atomizing feed nozzle to inject said hydrocarbon feed in a base portion of said riser reactor, said nozzle comprising:

a pressurizing section wherein a gas, selected from the group consisting of steam, hydrogen, and normally gaseous hydrocarbons, contacts said hydrocarbon feed and is at least partially dissolved in said hydrocarbon feed to produce a gas/liquid mixture having a pressure of 100 to 2000 psig and containing dissolved gas;

an expansion section wherein pressure of said pressurized mixture is reduced within less than 0.01 seconds to no more than 30% of the pressure in the pressurizing section and sufficient to:

cause at least a 3 fold expansion of the gas liquid mixture; atomize the liquid;

cause at least a portion of the dissolved gas to come out of solution and mechanically disrupt stacked structures in said liquid;

thermally crack said heavy feed by providing a time and temperature in said expansion section, as measured by Equivalent Reaction Time at 800° F. (ERT) of 5 to 500 ERT seconds; and produce an atomized, thermally cracked liquid feed containing disrupted stacked hydrocarbon structures with a reduced measured viscosity relative to said measured viscosity of said hydrocarbon feed; and a riser injection section, wherein said atomized, thermally cracked liquid is injected into said riser reactor.

10. The process of claim 9 wherein said nozzle has a cylindrical expansion section with a length to diameter ratio of at least 4:1.

11. The process of claim 9 wherein a high pressure drop nozzle is used to depressurize feed/gas into the expansion section, and the high pressure drop nozzle has a cross sectional area, and the expansion section has a cross sectional area in a direction normal to the nozzle outlet from 5 to 50 times the cross sectional area of the high pressure drop nozzle outlet.

12. The process of claim 9 wherein the pressure in said pressurizing section is 500 to 1500 psig.

13. The process of claim 9 wherein the pressure in said pressurizing section is 200 to 500 psig.

14. The process of claim 9 wherein the pressure in the expansion section is 5 to 60 psig.

15. The process of claim 9 wherein the pressure in the expansion section is 10 to 50 psig.

16. The process of claim 10 further characterized in that a lighter feed boiling above 650° F. is added higher up the riser reactor and wherein the weight ratio of heavy feed to lighter feed is at least 5:1.

17. The process of claim 16 wherein the weight ratio of heavy feed to lighter feed is at least 10:1.

18. The process of claim 9 wherein said heavy feed is subjected to 10 to 200 ERT seconds of thermal treatment in said expansion section.

* * * * *